US007052207B1

(12) United States Patent
Wimberger

(10) Patent No.: US 7,052,207 B1
(45) **Date of Patent: *May 30, 2006**

(54) SEDIMENT CONTROL DRAIN AND METHOD OF CONSTRUCTION

(76) Inventor: Brian J. Wimberger, 817-12th Ave. SE., Apt. 301, Minneapolis, MN (US) 55414-1482

( * ) Notice: Subject to any disclaimer, the term of this patent is extended or adjusted under 35 U.S.C. 154(b) by 0 days.

This patent is subject to a terminal disclaimer.

(21) Appl. No.: 10/453,562

(22) Filed: Jun. 3, 2003

Related U.S. Application Data

(63) Continuation of application No. 09/756,565, filed on Jan. 8, 2001, now Pat. No. 6,609,852.

(51) Int. Cl.
*E02B 11/00* (2006.01)
*E01F 5/00* (2006.01)
*E01C 11/22* (2006.01)

(52) U.S. Cl. ..... 405/40; 405/36; 405/41; 405/48; 405/52; 404/2; 404/5; 210/163; 210/170

(58) Field of Classification Search ..... 405/36, 405/39, 40, 41, 43, 45, 46, 48, 52, 53, 118; 404/2–5; 210/163–166, 532.1
See application file for complete search history.

(56) References Cited

U.S. PATENT DOCUMENTS

| | | | | | |
|---|---|---|---|---|---|
| 693,511 | A | * | 2/1902 | Garrett et al. | 210/163 |
| 810,879 | A | * | 1/1906 | Perry | 405/41 |
| 902,289 | A | * | 10/1908 | Gribben et al. | 210/163 |
| 1,141,678 | A | * | 6/1915 | Bailey | 210/163 |
| 1,457,637 | A | * | 6/1923 | Sievers | 210/163 |
| 1,541,436 | A | * | 6/1925 | Reshan | 210/163 |
| 1,601,498 | A | * | 9/1926 | Hirshstein | 210/163 |
| 1,711,674 | A | * | 5/1929 | Egan | 210/163 |
| 1,812,583 | A | * | 6/1931 | Cavalieri | 210/163 |
| 1,993,534 | A | * | 3/1935 | Stoltz | 210/164 |
| 2,182,795 | A | * | 12/1939 | Day | 210/164 |
| 3,246,582 | A | * | 4/1966 | Wade et al. | 210/165 |
| 3,439,505 | A | * | 4/1969 | Martin | 405/40 |
| 3,665,526 | A | * | 5/1972 | Hoffman | 4/287 |
| 3,695,153 | A | * | 10/1972 | Dorris | 404/4 |
| 4,345,998 | A | * | 8/1982 | Graffis et al. | 210/164 |
| 4,419,232 | A | * | 12/1983 | Arntyr et al. | 210/164 |
| 5,032,264 | A | * | 7/1991 | Geiger | 210/163 |
| 5,297,895 | A | * | 3/1994 | Johnson | 405/41 |
| 5,383,318 | A | * | 1/1995 | Kelley et al. | 52/287.1 |

(Continued)

FOREIGN PATENT DOCUMENTS

| | | | | |
|---|---|---|---|---|
| GB | 2217364 | * | 10/1989 | 404/4 |

OTHER PUBLICATIONS

Wimco Road Drain Brochure; page labeled p. 2 identified as "Road Drain Top Slab" illustrates a product that is admitted prior art and disclosure published undated.

*Primary Examiner*—Jong-Suk (James) Lee
(74) *Attorney, Agent, or Firm*—Westman, Champlin & Kelly, P.A.

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

12 Claims, 3 Drawing Sheets

U.S. PATENT DOCUMENTS 5,403,474 A * 4/1995 Emery ..... 210/163
5,405,539 A * 4/1995 Schneider ..... 210/747
5,582,720 A * 12/1996 Deming ..... 210/164
5,744,048 A * 4/1998 Stetler ..... 210/166
5,843,306 A * 12/1998 Singleton ..... 210/163
5,849,198 A * 12/1998 Sharpless ..... 210/164
5,954,952 A * 9/1999 Strawser, Sr. ..... 210/164
5,980,740 A * 11/1999 Harms et al. ..... 210/162
6,062,767 A * 5/2000 Kizhnerman et al. ..... 405/39
6,287,459 B1 * 9/2001 Williamson ..... 210/164
6,306,293 B1 * 10/2001 Schilling et al. ..... 210/164
6,406,620 B1 * 6/2002 Rogers ..... 210/162
6,517,709 B1 * 2/2003 Cardwell et al. ..... 210/164
6,521,122 B1 * 2/2003 Elliot et al. ..... 210/163
6,531,059 B1 * 3/2003 Morris et al. ..... 210/164
6,537,446 B1 * 3/2003 Sanguinetti ..... 210/163
6,558,077 B1 * 5/2003 Colson ..... 405/36
6,609,852 B1 * 8/2003 Wimberger ..... 405/40

* cited by examiner

SEDIMENT CONTROL DRAIN AND METHOD OF CONSTRUCTION

This is a continuation of my application Ser. No. 09/756,565, filed Jan. 8, 2001, now U.S. Pat. No. 6,609,852 B2 and priority is hereby claimed on application Ser. No. 09/756,565.

BACKGROUND OF THE INVENTION

The present invention relates to an erosion control basin and drain that is used during construction for preventing debris and sediment from entering the storm sewer. A basin that is provided will fit into a frame that will be used for the normal storm sewer drain grate, and will provide for catching debris, yet permitting water to be drained out.

Presently, when road and utility construction is undertaken, particularly in new building developments, a frame is put into place at storm sewer drains that are along the curb and gutters of streets. These frames are mounted onto the storm sewer stand pipes that have been previously installed, and in the normal process, the gutters are then formed around these frames. The curb and gutter around the grate and the curb box are generally hand formed, and during this process waste concrete that may be troweled off during finishing, or dropped, will enter the storm sewer structure, and it must be removed at the end of the installation. Additionally, during construction, particularly in new developments, if heavy rains occur, a large amount of debris and silt will be washed into the storm sewers all to the detriment of environmental conditions.

It is, however, during the forming of the curb and gutter around the storm sewer grate and frame that when concrete is most likely to fall into the storm sewer. The present device provides a simple, easily used insert basin and drain to be supported on the frame during construction to catch concrete, and other debris.

SUMMARY OF THE INVENTION

The present invention relates to a drain catch basin formed in a suitable manner, that will fit into a storm sewer drain frame, and which will catch and retain concrete waste, and other debris. The catch basin has a center perforated tube forming a drain tube, that is covered with a filtration sock, or fine mesh, to filter out large debris but yet let water pass through for draining as necessary. The upper opening of the tube, which forms a standpipe type structure, is left open so that in cases where heavy rains or heavy runoff is present, and the water starts to back up, there is a larger opening for permitting draining without flooding the street. Additionally, for overflow, a curb box is provided. The curb box is a frame laterally offset from the grate frame and around which the curb is formed. The curb box forms a passageway which is also open to the storm sewer. The curb box is only partially blocked with a wall of the basin of the present invention, so that there is an open space above the wall to provide for overflow into the curb box.

The basin, with its drain capabilities is left in place until the turf or other landscaping has been established around the curb, and the curb has been formed.

DETAILED DESCRIPTION OF THE PREFERRED EMBODIMENTS

Figure 1:
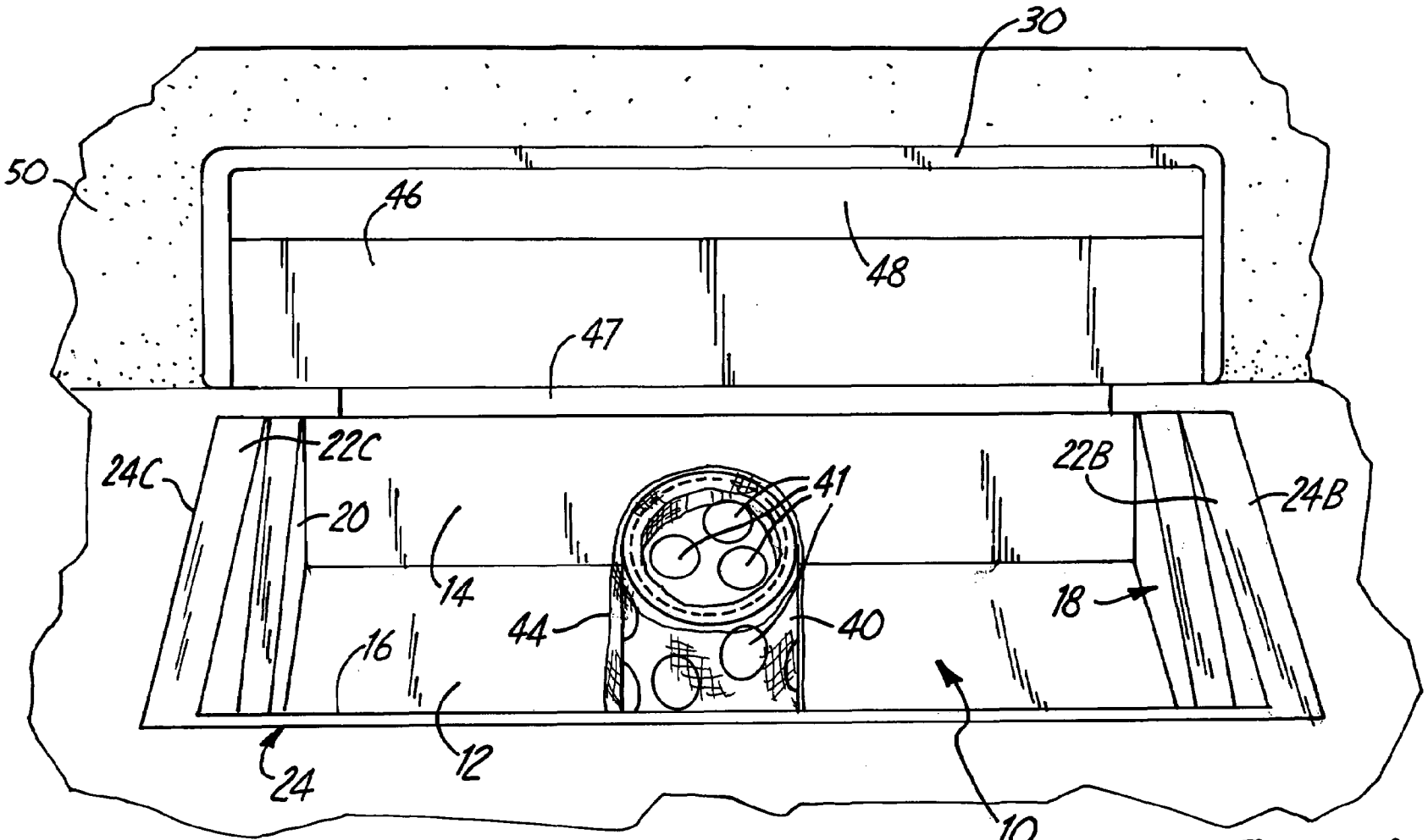
FIG. 1 is a top front perspective view of a catch basin made according to the present invention in a partially installed curb and gutter.
Figure 2:
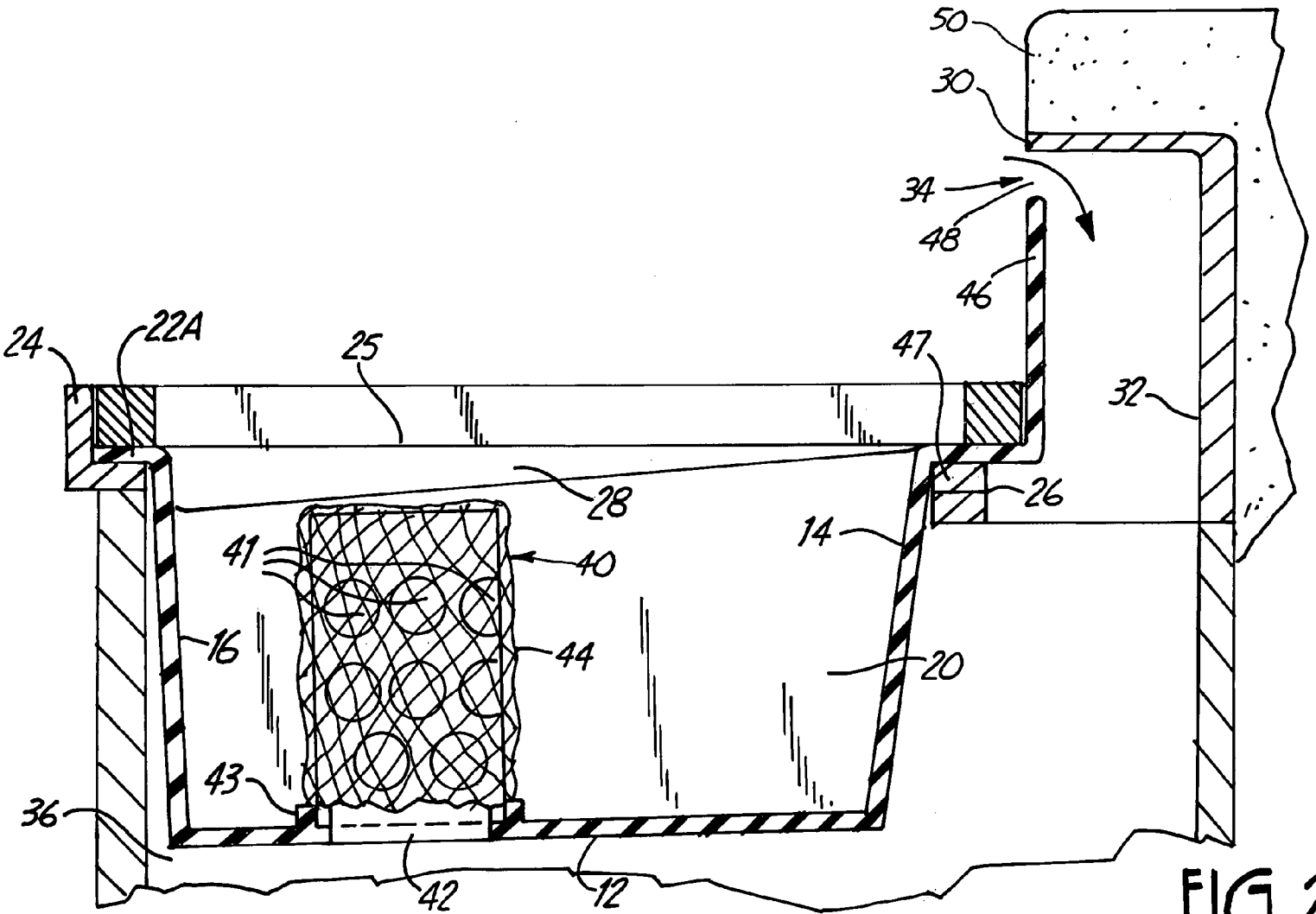
FIG. 2 is a schematic sectional view showing the catch basin installed in a frame, after using a curb box, and after a curb and gutter has been formed.
Figure 3:
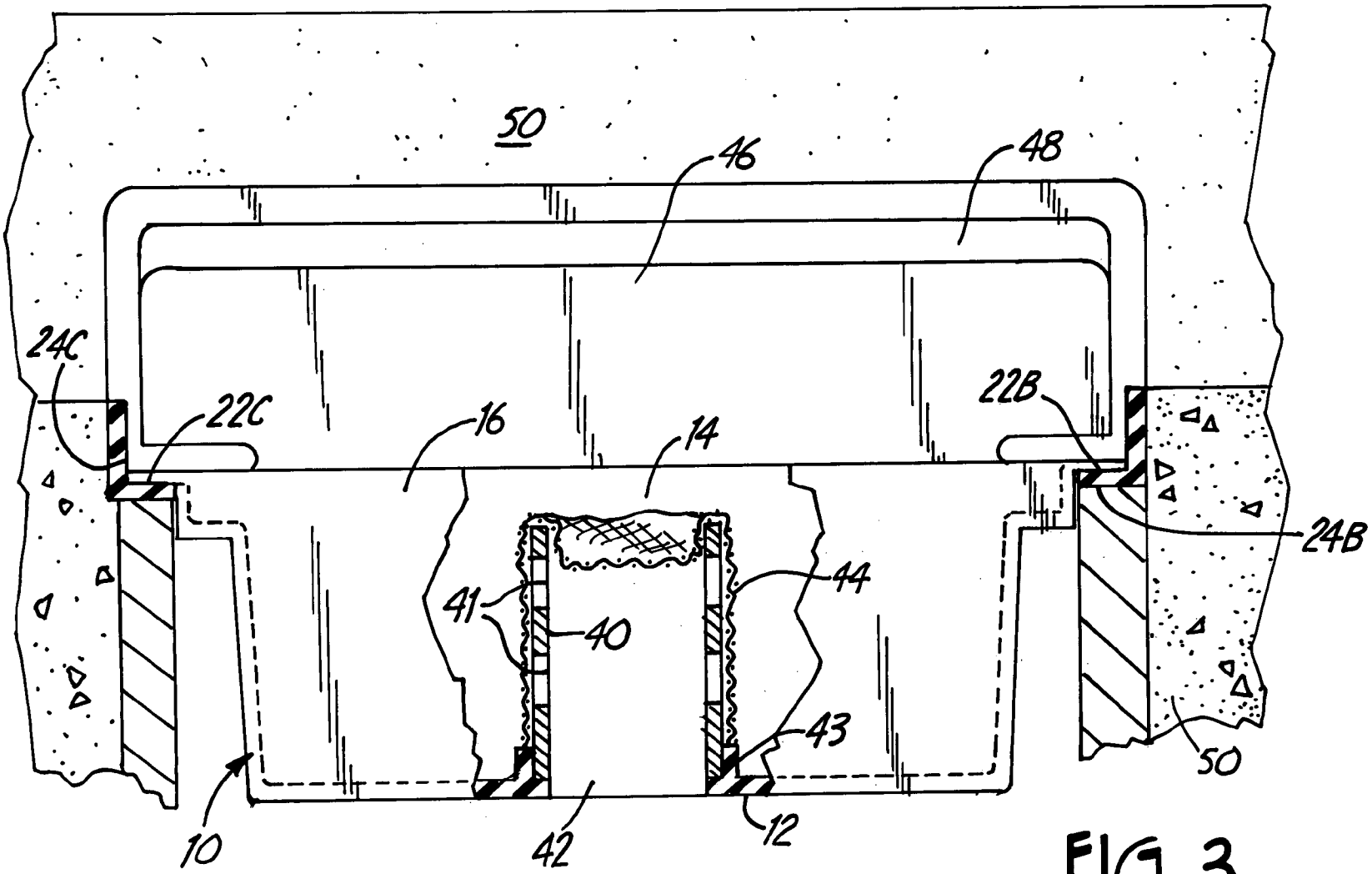
FIG. 3 is a front view of the catch basin of the present invention with parts broken away.

A catch basin forming an erosion control device is illustrated generally at 10, and made according to the present invention. The basin 10 is a open topped basin that has a bottom wall 12, a rear wall 14, a front wall 16, and side walls 18 and 20. The side walls and the front wall have flanges or lips 22 that are used for supporting the basin 10 in a frame 24 that is designed for containing a slated grate 25 for overlying the inlet to a storm sewer pipe shown schematically at 26. The frame 24 has a cross section shaped like an angle iron along the front and sides, and has a front member 24A that supports the flange 22A of the basin. The frame 24 has side members 24B and 24C which support flanges 22B and 22C. The rear cross member 26 of the frame 24 can be utilized. As shown a curb box 30 is part of the frame 24, and is made so that it will provide a shield wall 32 and an opening 34 leading into the storm sewer chamber 36.

The basin 10 has offset wall sections 28 between flanges 22B and 22C and the side walls that position the bottom wall 12 hold the bottom wall to be generally horizontal. A standpipe or drainpipe 40 is positioned to align over an opening 42 in the bottom wall 12. As shown the drainpipe 40 fits into a collar 43 formed on the bottom wall 12, and extends upwardly therefrom. The opening 42 at the bottom of the drain pipe 40 leads to the storm sewer pipe. The drainpipe 40 is a perforated plastic drain pipe with large holes 41 in it, and it is covered with a filter material or a filter sock 44 that is a mesh or other filter material that will filter out debris and sediment before the material enters into the interior of the drain 40. Water drains through the opening 42 into the storm sewer cavity 36.

The basin 10 can be made out of a suitable plastic material or formed metal, and the drainpipe 40 is then cemented in place or otherwise securely fastened. The collar 43 can be molded to the bottom wall 12, for holding the drainpipe in position, if desired.

The basin also has a sediment deflection wall shown at 46 at the rear or curb end. The plate 46 is offset from the rear wall with a flange 47 that can rest on frame cross member 26. The wall 46 fits into the inlet opening in the curb box 30 to partially block the opening. A space shown at 48 is left so that if serious flooding occurred, this space or gap would permit water to go through the curb box and into the storm sewer.

The top of the drain pipe 40 is left uncovered so it forms an opening, so that if water fills the basin it can overflow through the opening at the top of the drain pipe into the interior of the drain pipe and out the drain opening 42, to take care of storms or excessive drainage.

When the curb and gutter is formed, which is shown in FIG. 1, at 50, it is made of concrete, and is hand formed around the curb box or other structure, after the frame 24 for the grate 25 has been put into place. In other words, the frame 24 is supported on the frame cross member 26, and the concrete curb and gutter 50 is formed around the frame.

The basin 10 is put into place on the frame 24 before the curb and gutter is formed, and if any concrete or sand, or the like from the formation of the curb is broken off or discarded, it will not go down the storm drain, but rather will be caught in the basin 10.

Additionally, runoff water that may be carrying debris or other materials will be prevented from going directly into the storm drain, by the standpipe 40 and filter sock 44 that is used in the basin 10.

The basin 10 forms an open topped receptacle, with the bottom wall, side walls, and front and rear walls as shown. The basin can be designed in shape so that it will fit into the various types of frames used for storm sewer grates, as well as the rectangular form shown. Storm sewer frame castings are available in many shapes and sizes, and each erosion control basin then would be designed to fit into the frame with which it is used.

The frame 24 for the drain is set into place on the previously installed storm sewer, and supported in place. Then the basin 10 is put into the frame 24, and is supported on the lips that extend around at least three walls. The rear wall of the basin can be supported on a cross member of the frame 24 as well. Then the curb and gutter 50 is formed around the frame for the storm drain, and the basin 10 acts as a trap for debris or material that may be loosened or dropped when the concrete work is being done.

The basin is permitted to stay in place until the landscaping is completed to collect debris, salt, and other material that may be washed into the drain opening. The basin can be removed and dumped if it fills. The basin is removed when construction is completed.

Although the present invention has been described with reference to preferred embodiments, workers skilled in the art will recognize that changes may be made in form and detail without departing from the spirit and scope of the invention.

What is claimed is:

1. An erosion control basin for mounting in a grate frame used for a storm sewer grate, said grate frame having front, rear and side frame members defining a grate opening, the frame members having support flanges thereon, the basin comprising a single open topped receptacle fitted in the grate frame, and having wall portions forming a continuous peripheral wall and a bottom wall defining the single open topped receptacle, the receptacle being inside the grate frame, and flange members on the basin for supporting the basin on support flanges of the grate frame, and a drain from the basin comprising an upright pipe within the open topped receptacle and spaced from the continuous peripheral wall and having an interior forming a passageway opening to an outlet in the bottom wall of the receptacle, said upright pipe having a wall with a plurality of openings therethrough, and a sock filter surrounding said upright pipe and the openings in the wall of the pipe so that liquid in the receptacle is filtered through the sock filter before entering the interior of the pipe to exit from the outlet, the single, open topped receptacle being free of dividing walls between any portions of the peripheral wall such that all water entering the grate frame enters only the single receptacle.

2. The erosion control drain of claim 1, wherein the wall portions include a rear wall adjacent an overflow outlet of the storm sewer grate and a deflection plate attached to the rear wall along a flange that is substantially perpendicular to the rear wall, so the deflection plate is offset from the rear wall.

3. The erosion control basin of claim 2, wherein the basin is made of molded plastic.

4. The erosion control basin of claim 2, wherein the basin is made of metal.

5. In combination with a metal storm sewer grate frame defining a storm sewer drain opening, said grate frame being substantially at ground level, a basin supported within the grate frame and including a bottom wall that is positioned below ground level, said basin having walls that extend upwardly from the bottom wall which are supported on the grate frame, the basin comprising a single open top receptacle fitted in the grate frame, and having a continuous peripheral upright side wall surrounding and joined to the bottom wall to define an open top receptacle within the grate frame, the continuous peripheral wall having a flange for supporting the basin on the grate frame, the bottom wall having a drain outlet therein, an upright pipe supported on the bottom wall and surrounding the drain outlet, the upright pipe having an interior opening forming a passageway opening to the drain outlet in the bottom wall, and having a plurality of openings in the wall of the pipe such that water in the receptacle passes through the openings in the wall of the pipe to be carried out through the drain outlet, and a fabric type filter surrounding said pipe and the openings in the pipe so that water in the basin is filtered through the filter before entering the interior of the pipe to exit from the drain outlet in the bottom wall, the basin being the only receptacle for liquid within the opening of the grate frame to provide a sediment filter for all water exiting out through the drain outlet in the bottom wall.

6. An erosion control basin for mounting in a grate frame used for a storm sewer inlet laterally adjacent a street curb, the grate frame having front, rear and side frame members defining an upwardly facing grate opening in a street gutter, and the storm sewer inlet having an opening on a lateral side of the grate frame above the grate opening and defined in the street curb, the erosion control basin comprising an open top receptacle of size to fit into the grate frame and be supported thereon, a filtered drain from the erosion control basin to filter water draining from the open top receptacle including a filter supported in the basin below a top opening of the open top receptacle, and a substanially imperforate deflector wall along one side of the erosion control basin and at least partially blocking the opening on the lateral side of the storm sewer inlet to deflect water into the erosion control basin.

7. The erosion control basin of claim 6, wherein the deflector wall extends generally uprightly from a generally horizontal plane of the grate frame.

8. The erosion control basin of claim 7, wherein the deflector wall extends over the opening on the lateral side of the grate frame and is a generally planar wall.

9. An erosion control housing for mounting a grate frame used for a storm sewer inlet, the grate frame having peripheral members defining an upwardly facing grate opening positioned laterally of a street curb and in a street gutter, and the storm sewer inlet having a lateral opening on a lateral side of the grate frame and extending upwardly from the grate opening, the erosion control housing having an open top and being of size to fit into the grate frame and having flanges that rest on the grate frame to be supported thereon, a drain opening defined by the erosion control housing, the erosion control housing having a filter support to support a filter to filter water entering the open top and exiting the drain opening, and a deflector wall along one side of the erosion control housing and at least partially blocking the lateral opening of the storm sewer inlet to deflect water into the open top of the erosion control housing.

10. The erosion control housing of claim 9, wherein the deflector wall is supported on a flange of the erosion control housing, and the flange comprising an upright wall offset laterally from the open top of the erosion control housing.

11. The erosion control housing of claim 9, wherein the flanges of the erosion control housing are configured to include portions to support a slated grate that overlies the grate frame.

12. The erosion control housing of claim 9, and an opening for overflow defined by portions of the erosion control housing below the open top and above the drain opening to form a drain when water level in the erosion control housing exceeds a pre-determined level.

* * * * *

US007052207C1

(12) EX PARTE REEXAMINATION CERTIFICATE (8833rd)

United States Patent

Wimberger

(10) Number: US 7,052,207 C1

(45) Certificate Issued: *Jan. 31, 2012

(54) SEDIMENT CONTROL DRAIN AND METHOD OF CONSTRUCTION

(75) Inventor: Brian J. Wimberger, Minneapolis, MN (US)

(73) Assignee: Wimco, LLC, Shakopee, MN (US)

Reexamination Request:
No. 90/009,717, Apr. 5, 2010

Reexamination Certificate for:

| | |
|---|---|
| Patent No.: | **7,052,207** |
| Issued: | **May 30, 2006** |
| Appl. No.: | **10/453,562** |
| Filed: | **Jun. 3, 2003** |

( * ) Notice: This patent is subject to a terminal disclaimer.

Related U.S. Application Data

(63) Continuation of application No. 09/756,565, filed on Jan. 8, 2001, now Pat. No. 6,609,852.

(51) Int. Cl.

| | |
|---|---|
| ***E02B 11/00*** | (2006.01) |
| ***E01F 5/00*** | (2006.01) |
| ***E01C 11/22*** | (2006.01) |

(52) U.S. Cl. ..... 405/40; 405/36; 405/41; 405/48; 405/52; 404/2; 404/5; 210/163; 210/170.03

(58) Field of Classification Search ..... None
See application file for complete search history.

(56) References Cited

To view the complete listing of prior art documents cited during the proceeding for Reexamination Control Number 90/009,717, please refer to the USPTO's public Patent Application Information Retrieval (PAIR) system under the Display References tab.

*Primary Examiner*—Jeffrey L. Gellner

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

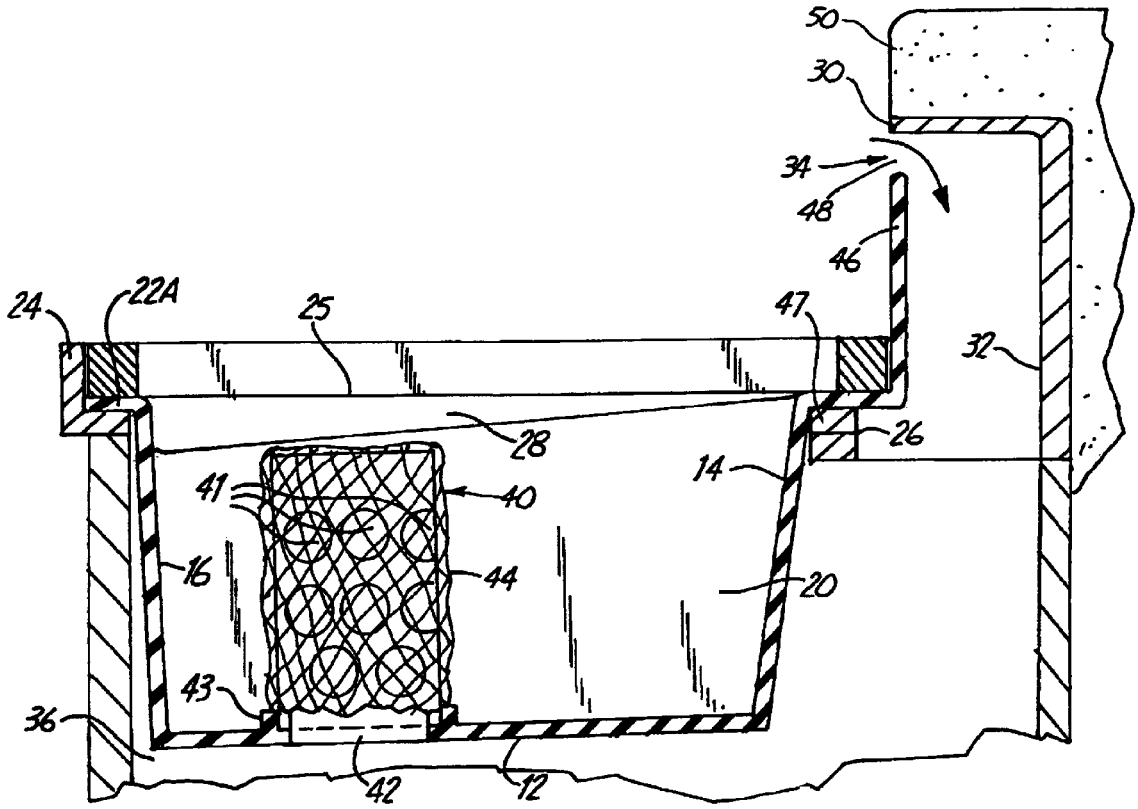

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 6-8 is confirmed.

Claims 1-5 and 9-12 are cancelled.

* * * * *